United States Patent [19]

Cohen

[11] 4,450,596

[45] May 29, 1984

[54] RECTAL HYGIENE SYSTEM

[76] Inventor: Marvin C. Cohen, 829 Timber La., Dresher, Pa. 19025

[21] Appl. No.: 350,512

[22] Filed: Feb. 19, 1982

[51] Int. Cl.[3] ..... E03D 9/08

[52] U.S. Cl. ..... 4/447; 4/420.2

[58] Field of Search ..... 4/443–448, 4/420.1–420.5; 219/304–307; 128/248; 239/396, 590.3; 138/40

[56] References Cited

U.S. PATENT DOCUMENTS

| | | | |
|---|---|---|---|
| 1,356,818 | 10/1920 | Hadaway, Jr. | 219/305 |
| 3,195,148 | 7/1965 | Merkel, Jr. | 4/447 |
| 3,430,268 | 3/1969 | Zoberg | 4/447 |
| 3,719,595 | 3/1973 | Johnson | 138/40 |
| 3,845,509 | 11/1974 | Lieber | 4/420.5 |
| 4,062,071 | 12/1977 | Blanquet | 4/447 |

*Primary Examiner*—Stephen Marcus
*Assistant Examiner*—Kenneth S. Putnam
*Attorney, Agent, or Firm*—John J. Simkanich

[57] ABSTRACT

A rectal hygiene system for use in conjunction with an existing toilet, having a control valve with a water connection to the cold water supply line of the existing toilet tank, as well as a spray member attached to the underside of the toilet seat at the back end thereof, this member being of small size and light weight and movable with the toilet seat, providing a directed spray into the toilet seat opening from the back end of the toilet seat.

4 Claims, 5 Drawing Figures

RECTAL HYGIENE SYSTEM

BACKGROUND OF THE INVENTION

This invention relates to personal hygiene water spray systems, and especially those systems used in connection with toilet units and bidets.

Personal hygiene systems, especially those used for the treatment of rectal disorders and the like have been developing over the years. Most of these systems provide apparatus for spraying water in a fountain-like spray pattern from a special purpose bidet bowl or dedicated facility which is not designed nor capable of successfully being used as a toilet facility.

Riegelman, U.S. Pat. No. 4,237,560, provides a special purpose bidet system having a water tank member. The Riegelman dedicated bidet facility includes a special seat incorporating front and rear water jet nozzles, as well as a water tank and heated air blower fan constructed as an integral structure and located adjacent to the seat opening making the seat heavy and cumbersome to lift. The Riegelman water tank includes a tube type water heater element which is wound upon itself throughout the water tank.

Fishko, U.S. Pat. No. 2,427,953, provides an apparatus for treatment of rectal disorders including a special purpose bowl or receptacle having an upwardly extending spray nozzle positioned in the middle thereof. This special purpose unit includes a control apparatus and piping for spraying both hot and cold water as well as medicinal fluid.

Zoberg, U.S. Pat. No. 3,430,268, provides a bidet appliance which is adaptable for mounting to a toilet seat or toilet bowl to emit a spray of water at a desired temperature. The Zoberg system provides this water from a water diverter pipe or conduit mounted on a hot and cold water mixing faucet such as a sink. Zoberg provides a water distribution plate which is attached between the bottom of the toilet seat and the hinge for the toilet seat. This distribution plate is large and cumbersome and extends into the toilet seat opening and provides a plurality of water hose connections of varying cross-section, thereby providing varied metered flow outlets. A hose is attached to any of these outlets, or as an alternative, one or more spray nozzles are positioned on one or more of these outlets to project into the toilet seat opening. In each instance, however, when a spray nozzle is attached to the toilet seat or a hose connection is attached thereto, this nozzle or hose connection projects beyond the edge of the Zoberg toilet seat into the toilet seat opening where it can be contaminated.

Zoberg provides another alternative embodiment wherein a water distribution element includes a plate mounted to the toilet bowl by the seat highe screws and permanently extends into the bowl opening at a position beneath and behind the toilet seat opening when, and only when, the toilet seat is down on the toilet bowl. This alternate embodiment necessitates the use of a front toilet seat spacer pad which is attached to the underneath portion of the front of the toilet seat to prevent leakage of water or urine over the top of the toilet bowl. The permanent projections of the distribution element into the bowl opening allows for dirt and bacteria accumulation.

Parisini, U.S. Pat. No. 2,104,271, provides a device for spraying a fountain of water in the middle portion of a toilet bowl. The device is attached to the underside of a toilet bowl seat and includes a flexible tube which extends into the middle of the toilet seat opening and holds the upwardly directed spray nozzle. The apparatus is of substantial size and weight and is screwed or otherwise clamped to the bottom of the toilet seat by means of a mounting bracket and uses a handle to move the flexible tube about in position into the seat opening where it can be contaminated during use.

The devices provided in the prior art, as discussed above, are either special purpose bidet systems which require additional equipment in the bathroom or include cumbersome apparatus incorporated into or attached to the seat which either projects into the toilet seat opening or is attached to the toilet bowl in such a manner that it extends over into the toilet bowl opening when the toilet seat has been raised. Structures which project into the toilet seat opening or bowl opening provide surfaces for the accumulation of dirt and bacteria.

An object of the present invention is to provide a rectal hygiene system which is adaptable to a previously existing toilet unit and which does not hamper or alter the normal operation of such toilet unit.

A second object of this invention is to provide such a rectal hygiene system wherein the plumbing or tubing apparatus and structure does not project into the toilet seat opening.

Another object of this invention is to provide such a rectal hygiene system which does not extend over or into the toilet bowl opening once the toilet seat has been raised.

Another object of this invention is to provide a disparate water supply and a heated water source necessitating only a simple water projector which is light and compact of structure, on the toilet unit proper, and which is mounted to the underside of the toilet seat in such a manner as to be away from the toilet seat opening while being capable of directing a spray into that opening.

A further object is to provide such a water projector which has no moving parts and which is light of structure so as not to interfere with the operation of the toilet seat or disrupt its balance.

SUMMARY OF THE INVENTION

The objects of this invention are realized in a rectal hygiene system adaptable for use with a previously existing standard type toilet unit. The system is connected to the cold water supply to the toilet tank and has a temperature controlled water supply reservoir selectively pressurized by the household water supply and positionable adjacent to but disparate from the toilet bowl.

The water supply reservoir includes a thermostatically controlled immersion (aquarium) heater and temperature-evening water pickup coil.

A small, compact and relatively light water projector block is attached to the underside of the toilet seat opening and below the plane of the bottom of the seat enabling a water spray trajectory into the opening.

A metering device in the supply line to the water supply reservoir controls both the pressure and rate of flow of the water spray through the water projector block.

DESCRIPTION OF THE DRAWINGS

The advantages, features and operation of this invention will be better understood from the reading of the following detailed description of the invention in conjunction with the attached drawings in which like numerals refer to like elements and in which.

DETAILED DESCRIPTION OF THE INVENTION

Figures 1, 2, 3:
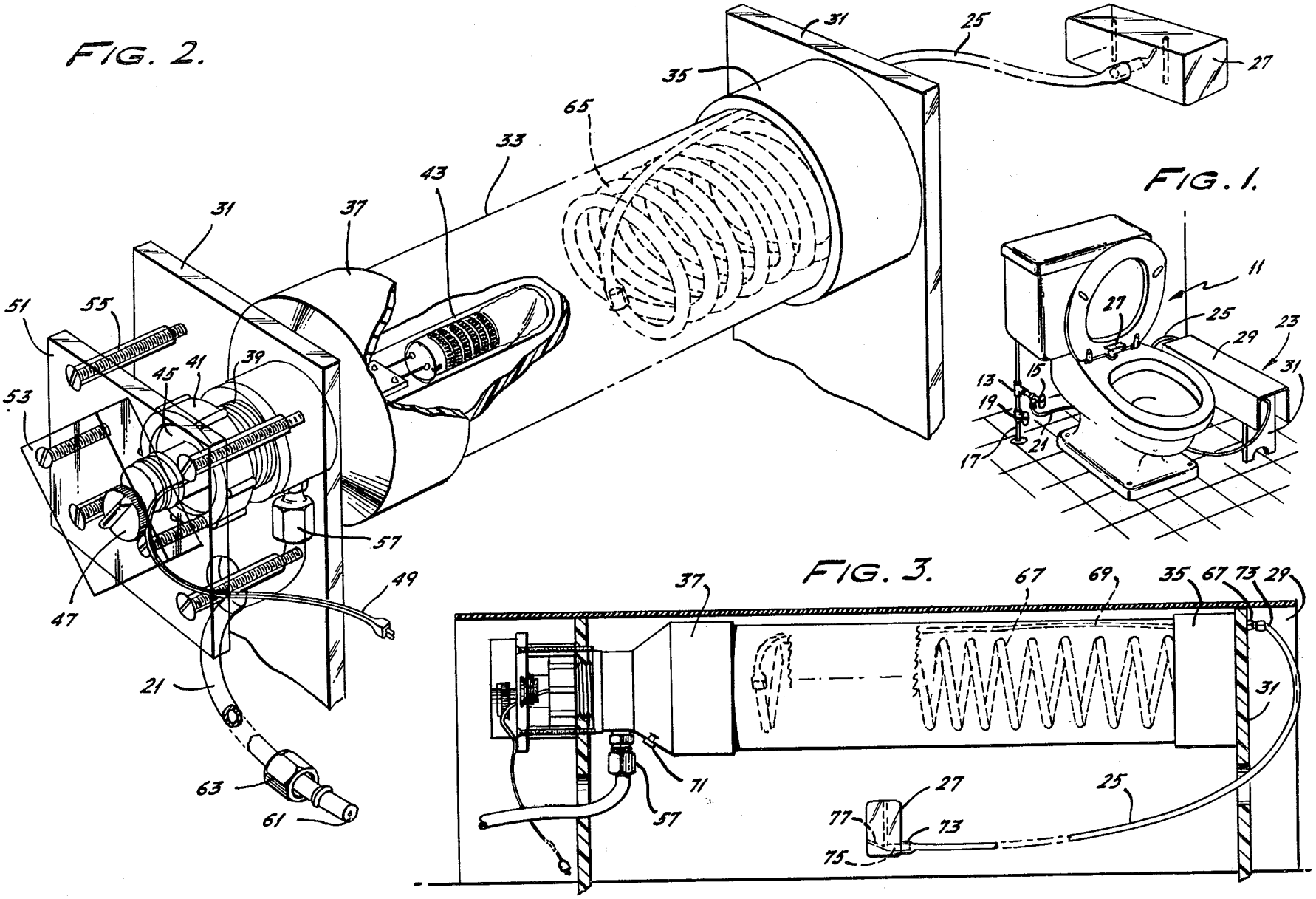
FIG. 1 is an assembly view of the rectal hygiene system connected to the toilet unit.
FIG. 2 is a partial cut away perspective view of the water supply reservoir and projector block with hose connections of the assembly of FIG. 1.
FIG. 3 is a side partial cut away view of the water supply reservoir and hose connected water projector block of FIG. 1 showing the temperature-evening coil within the water supply reservoir.

A rectal hygiene system is constructed to be adapted for use with a standard household, industrial or hospital standard toilet unit. This system, FIG. 1, has components which can be positioned adjacent to or disparate from the toilet unit 11 or under the toilet tank and includes a take off "T" 13 and valve 15 for tapping the cold water household water supply 17 downstream from the toilet bowl shut off valve 19.

A flexible hose 21 is connected between the take off valve 15 and a water supply reservoir 23. A second flexible hose 25 connects the outlet of the water supply reservoir 23 to a projector block 27 which is attached to the bottom side of the toilet seat at the rear portion thereof.

Water supply reservoir 23 includes a skirt-type cover 29 and is supported by a pair of rectangular legs 31 on either end.

Water supply reservoir 23, FIG. 2, includes a tank 33 supported between the pair of rectangular legs 31. The rectangular legs 31 can be made of quarter inch clear plastic plexiglass material 12 inches high and 4 inches wide or other suitable material capable of supporting about 7 pounds of weight. The tank 33 is made from 3 inch I.D. PVC plastic pipe approximately 12 inches long with an end cap 35 forming a closure at one end and a 3 inch by 1½ inch reducer 37 positioned on the other end.

The end cap 35 is bolted or otherwise secured to the first one of the rectangular legs 31 while the reducer carries a threaded neck 39 extension by which it is secured to and extends through the other of the rectangular legs 31. A threaded ring 41 tightens down on the threaded neck extension 39 to hold that reducer 37 end against its respective mated rectangular leg 31. The threaded neck extension 39 and threaded ring 41 received thereon can also be made of PVC plastic.

A resistant type immersion heater 43 extends about 6 inches into the tank 33 through the threaded neck extension 39 and the reducer 37 and is held sealingly in place by a plurality of gaskets 45 and the threaded ring 41.

Immersion heater 43 can have 100 watt capacity and be thermostatically controlled by means of a temperature control knob 47 on the outside of the tank and be powered from a standard 110 volt ac power cord 49. This heater 43 is an aquarium immersion type heater, having a resistance wire wound heating element **43*a* encased in a glass tube 43*b*. A one-quarter inch thick approximately 3 inch by 3 inch plexiglass plate 51 and one half inch high rectangular plexiglass cap 53 are positioned about the temperature control knob 47 by four spacer mounting screws 55 mounted on the rectangular leg 31**.

A standard one half inch brass tubing coupling and compression ring tubing cap 57 provides a tubing fitting with the tank at the neck portion of the reducer 37.

The first flexible hose 21 can be made of a number of different materials but most easily is made of ⅜ inch O.D. plastic tubing. When ⅜ O.D. plastic tubing is used for this flexible hose 21, a reinforcement insert 59 is used. Typically, this insert 59 is a one-quarter inch I.D. rigid plastic sleeve with a one-eighth inch center bore. The reinforcement insert sleeve 59 can be about one inch long.

A metering plug 61 about ⅜ths to 1 inch long is used in the opposite end of the flexible plastic hose 21. This metering plug 61 carries a center hole equal to the size of the opening in the nozzle block 27 and is made from a quarter inch plastic dowl to act concurrently as the reinforcement sleeve similar to the insert sleeve 59. The metering plug 61 end of the flexible plastic hose 21 is secured to the take off valve 15 via a compression ring end cap 63. By making the metering plug 61 bore the same size as the spray nozzle opening in the nozzle block 27, excessive pressure on the water supply reservoir 23 is eliminated regardless of the setting of the take off valve 15. Typically, this bore is 1/16th of an inch in diameter.

Situated within the cylindrical tank 33 of the supply reservoir 23 is a temperature-evening coil 65.

This coil 65, FIG. 3, is made from quarter inch O.D. tubing of copper, aluminum or other material and is wound in an approximately 2½ inch diameter helical coil approximately 10 inches long. One end of this coil 65 is connected via a half inch brass double tubing coupling 67 through the top side of the end cap 35. The other end of the coil 65 has an approximately 12 inch length of ⅜ I.D. plastic tubing which acts as a pick up tube and has its free end adjacent to the brass double tubing coupling 67 at the interior top portion of the end cap 35. A drain or bleeder plug 71 extends through the conical portion of the reducer 37 adjacent to the brass tubing coupling 57.

The skirt type top cover 29 can have open ends and can be approximately 18 inches long, 4½ inches wide with about 4½ inch skirt drop on either side. This cover 29 can be screwed, bolted or otherwise secured to either the pair of rectangular legs 31 or the end cap 35 and reducer 37 and can be made of plastic or other material.

A quarter inch O.D. flexible plastic tubing, being the second flexible hose 25, connects the projector block 27 to the outside of the double tubing coupling 67. This tubing 25 carries cylindrical reinforcement sleeves 73 on either end thereof.

The projector block 27 is approximately ⅝ inches wide by 2 inches long by ¾ of an inch high and carries a first horizontal bore 75 connected to a second canted or angled bore 77. The first horizontal bore 75 is approximately 3/16 inch in diameter and is positioned approximately in the middle of the projector block 27 about 3/16ths from the bottom thereof. In the "horizontal", indicates this first bore 75 provides a conduit extending in an approximate horizontal plane when the nozzle block is attached to a toilet seat and the seat is down on the toilet bowl. The second canted or angled bore 77 is about 1/16 of an inch in diameter and is carried off from the horizontal bore 75 at an angle of about 30° at a point approximately the middle of the projector block 27.

As the system operates under very low pressure, the first and second flexible hoses 21, 25 as well as the pick off tube 69 can be made of hardware grade clear flexible plastic or vinyl tubing. It is preferred that the temperature-evening coil 65 be of metal or other good heat transfer material. This coil 65 configuration is used to promote and insure an even mixing and tempering of the water delivered out of the tank 33 outlet fitting 67 through the second flexible hose 25, and to the projector block 27. Although the resistance heater 45 is positioned at approximately the mid-point of the tank 33, this tank 33 being essentially a horizontally positioned cylinder, there tends to be temperature separation layers within this tank which can be noticed when the hygiene system is used. To promote an even mixing, water is taken off at the top of the cylindrical tank 33 and carried along an extended heat transfer coil 65, the length of the tank 33 to even out the temperature to a desired temperature within the 95°–104° F. range.

Figure 4:
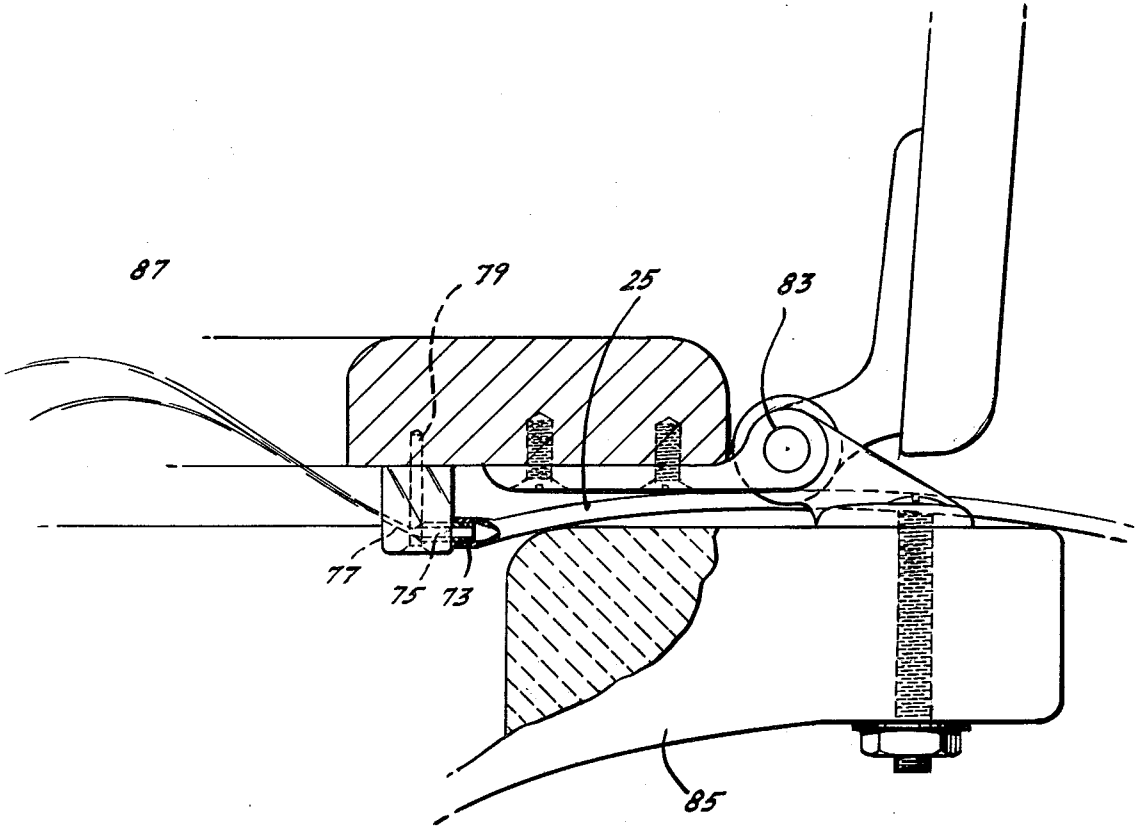
FIG. 4 shows a side elevation of the projector block of the assembly of FIG. 1 illustrating the spray trajectory provided by the projector block when installed on the toilet seat.

Projector block 27, FIG. 4, can be made of clear lucite plastic. This block 27 can have a pair of drilled mounting holes 79 for mounting the top of the block 27 flush with the bottom of a toilet seat 18 at a point at the rear of the seat and inwardly from the edge of the seat 81 approximately one-quarter to one-half inches. The second flexible plastic hose 25 is of sufficient length and size to fit between the toilet seat hinge 83 and to be carried with the projector block 27 when the seat 81 is raised.

When the toilet seat 81 is raised, the projector block 27 and second flexible hose 25 are carried to a vertical position with it. Since the block 27 is made of light plastic it does not throw off the toilet seat 81 balance which would cause the seat to fall down. As the block 27 has smooth surfaces it does not readily accumulate dirt and bacteria. When the toilet seat 81 is down on the toilet bowl 85 the projector block 27 is positioned out of the way of the toilet seat 81 opening and away from the edge of the bowl 85. By having this projector block 27 with its projector opening, the bore 77 "dropped" approximately one-quarter inch below the toilet seat 81 and approximately ¼ to ½ inch behind the opening, this projector block 27 is able to provide a fountain spray 87 in an elliptical pattern into the toilet seat 81 area. The simple construction of the projector block 27 allows for ease of cleaning and provides no surfaces for the accumulation of dirt or bacteria.

Figure 5:
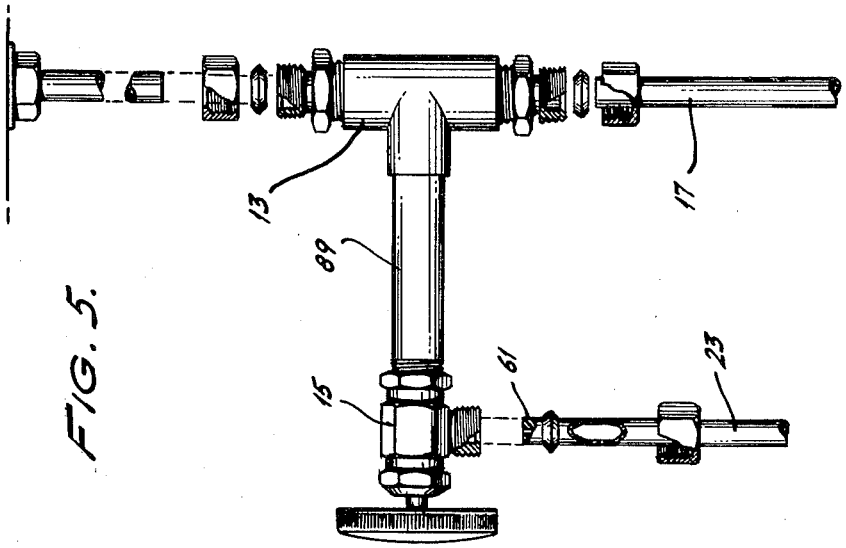
FIG. 5 shows the pipe couplings and valving of the water supply hose to the water supply reservoir from the pressurized household water supply.

The water supply reservoir 23 take off tubing, i.e., flexible hose 23 is connected via the take off valve 15, FIG. 5. A three inch long ⅜ inch I.D. pipe 89 is connected to the "T" take off 13 inserted in the household water supply line 17 to the toilet tank. These materials are of standard design and readily available from any commercial plumbing supply.

The take off valve 15 is operated by a user of the toilet 11. When the valve 15 is opened the metering plug 61 allows a fixed rate of water to pass into the water supply reservoir 23 pressurizing this supply reservoir regardless of the amount of opening of the valve 15 beyond a threshold point equal to the cross-sectional area of the bore in the metering plug 61. When the reservoir 23 is pressurized, water warmed and thermostatically controlled therein is forced out of the second flexible hose 25 to the projector block 27 to be sprayed into the toilet seat 81 opening. This spraying continues until the operator closes the valve 15 and the pressure dissipates, this dissipation taking a matter of a few seconds. The immersion heater 43 being of the type obtained from Penn Plax Corporation of Garden City, N.Y., may be electrically connected at a point (away) from the toilet bowl 85 having an electrically insulated supply cord can eliminate electrical shock hazard. The operator will not come in contact with the electrical heating components nor will the electrical heating components come in contact with water around the toilet.

Many changes can be made in the above rectal hygiene system without departing from the intent and scope thereof. It is intended that the above description shall be interpreted as illustrative and not be taken in the limiting sense.

What is claimed is:

1. A rectal hygiene system suitable for use in connection with a standard type toilet seat of a standard type toilet, the toilet seat having a toilet seat opening and the toilet including a bowl, without change of said toilet seat and toilet position or relation, comprising:

a spraying projector block suitable for providing a fountain of water, said projector block having a first larger size bore thereinto through a first face of said block, and a second smaller bore meeting said first bore and extending through said projector block to a second face thereof, said first and second bores meeting at approximately a 30° angle, said second bore terminating in a water expressing aperture, said projector block suitable for attachment to the bottom of said toilet seat, and spaced behind the toilet seat opening, said projector block being positioned entirely within said bowl space when said toilet seat is down on said bowl, said water expressing aperture being shielded from contamination in both a raised and lowered seat position;

a horizontally positionable cylindrical tank positionable away from said toilet;

a pair of rectangular plates positioned one each on either end of said cylindrical tank, supporting said tank above a surface;

an electrical resistance heater for heating water in said tank extending partially into said tank from a first end thereof, said heater having an electrical insulation tube separating it from said tank interior;

a temperature-evening coiled tube within said tank immersed in said heated water in said tank having a first open coiled tube end for receiving heated water proximate an end of said tank, said coiled tube extending toward an opposite end of said tank partially into the length of said tank and terminating in a second coiled tube end;

a first fitting through said second end of said tank;

a pick off tube connected to said coiled tube at said second end thereof and terminating proximate to said second end of said tank; and first fluid duct means for connecting said first end of said tank to a household water supply, and second fluid duct means for connecting said fitting to said projector block larger size bore, water in said tank passing through said temperature-evening coil prior to discharge for use through said fitting, having acquired an even, constant desired temperature during passing through said coil.

2. The system of claim 1 wherein said fluid duct means includes:

a take off connector suitable for connecting to a household cold water supply;

a second fitting through said tank first end wall;
a valve connected to said take off connector;
a first length of flexible plastic tubing connecting said valve outlet to said tank second fitting;
a metering plug being positioned within said flexible tubing at said valve outlet connection;
a second length of flexible plastic tubing connecting said tank first fitting to said projector block larger size bore;
wherein said coiled tube is of heat conductive metal; and
wherein said pick off tube is of plastic.

3. The system of claim 2 wherein said projector block is a rectangular block of plastic; wherein said electrical resistance heater has a thermoplastic control, the adjustment for which is exterior to said tank; and wherein said tank is of plastic material.

4. The system of claim 3 wherein said plastic cylindrical metering plug within said first length of tubing has a center bore equal in size to said projector block second bore.

* * * * *

UNITED STATES PATENT AND TRADEMARK OFFICE

CERTIFICATE OF CORRECTION

PATENT NO. : 4,450,596

DATED : May 29, 1984

INVENTOR(S) : Marvin C. Cohen

It is certified that error appears in the above-identified patent and that said Letters Patent is hereby corrected as shown below:

| | |
|---|---|
| Col. 5, line 26 | "18" should be -- 81 --. |
| Figure 2 | Add numerals --43a-- to heater element and --43b-- to heater tube. |
| Figure 3 | Immediately after the words "Figure 3" the numeral "67" should be --65--. |

Signed and Sealed this

*Ninth* Day of *October 1984*

[SEAL]

*Attest:*

*Attesting Officer*

GERALD J. MOSSINGHOFF

*Commissioner of Patents and Trademarks*